US005520598A

United States Patent [19]

Little

[11] Patent Number: 5,520,598

[45] Date of Patent: May 28, 1996

[54] LEG EXERCISING DEVICE AND METHOD

[76] Inventor: Oscar L. Little, 14 Scuppo Rd., Danbury, Conn. 06810

[21] Appl. No.: 511,061

[22] Filed: Aug. 3, 1995

Related U.S. Application Data

[63] Continuation-in-part of Ser. No. 344,944, Nov. 25, 1994.

[51] Int. Cl.[6] ..... A63B 23/04

[52] U.S. Cl. ..... 482/79; 482/51

[58] Field of Search ..... 482/79, 80, 51, 482/907, 148, 92, 93, 94

[56] References Cited

U.S. PATENT DOCUMENTS

| | | | |
|---|---|---|---|
| 3,020,046 | 2/1962 | Hotas | 482/79 |
| 4,340,214 | 7/1982 | Schutzer | 272/70 |
| 4,577,861 | 3/1986 | Bangerter et al. | 482/79 |
| 4,781,372 | 11/1988 | McCormack | 482/51 |
| 5,209,711 | 5/1993 | Scrima | 482/70 |
| 5,316,530 | 5/1994 | Romer | 482/71 |
| 5,328,427 | 7/1994 | Sleamaker | 482/71 |

*Primary Examiner*—Stephen R. Crow
*Attorney, Agent, or Firm*—John H. Crozier

[57] ABSTRACT

In a preferred embodiment, a combination leg exercise device, including: a base member; two, elongate, parallel plates attached to rotating apparatus mounted on the base member; and support apparatus disposed at distal ends of the plates to accommodate thereon selected weights; such that a person standing on the plates, with a foot disposed over each of the rotating apparatus, moves the weights between a first, lowered position and a second, elevated position by alternatingly flexing and relaxing muscles in the person's lower legs; the device further including: two track assemblies extending horizontally from the base member; and the track assemblies including thereon two wheeled platforms; such that a person standing with a foot on each of the platforms, slides the platforms back and forth along the track assemblies by alternatingly flexing and relaxing inner and outer muscles in the person's upper legs.

8 Claims, 5 Drawing Sheets

LEG EXERCISING DEVICE AND METHOD

CROSS-REFERENCE TO RELATED APPLICATION

The present application is a continuation-in-part of my co-pending application Ser. No. 08/344,944, filed Nov. 25, 1994, pending.

BACKGROUND OF THE INVENTION

1. Field of the Invention

The present invention relates to exercise devices generally and, more particularly, but not by way of limitation, to novel exercise device and method for exercising the legs.

2. Background Art

Physical exercise has become increasingly popular, as it improves a person's feeling of general well-being and is even thought to decrease the incidence of disease and to lengthen a person's life span. Exercising has been demonstrated to have certain specific benefits such as increasing a person's blood level of desirable high density lipoproteins, decreasing osteoporosis-causing loss of calcium in the bones, and decreasing blood pressure.

Many exercise devices are relatively expensive and space-consuming, as well as being difficult to transport easily. This is particularly true of devices for exercising the legs.

Another limitation of many exercise devices is that each is limited to exercising a specific muscle group. The device described in the above-referenced co-pending patent application is directed to exercising only the lower legs. Other leg exercising devices are designed to exercise the upper muscle groups of the legs by assisting in performing leg splits, but do nothing to exercise the lower legs.

Accordingly, it is a principal object of the present invention to provide leg exercising device and method that can be used to exercise more than one group of leg muscles.

It is a further object of the invention to provide such device that can be disassembled and folded for convenient storage and portability.

It is another object of the invention to provide such a device that is lightweight.

It is an additional object of the invention to provide such a device that can be economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a combination leg exercise device, comprising: a base member; two, elongate, parallel plates attached to rotating means mounted on said base member; and support means disposed at distal ends of said plates to accommodate thereon selected weights; such that a person standing on said plates, with a foot disposed over each of said rotating means, moves said weights between a first, lowered position and a second, elevated position by alternatingly flexing and relaxing muscles in the person's lower legs; said device further comprising: two track assemblies extending horizontally from said base member; and said track assemblies including thereon two wheeled platforms; such that a person standing with a foot on each of said platforms, slides said platforms back and forth along said track assemblies by alternatingly flexing and relaxing inner and outer muscles in the person's upper legs.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
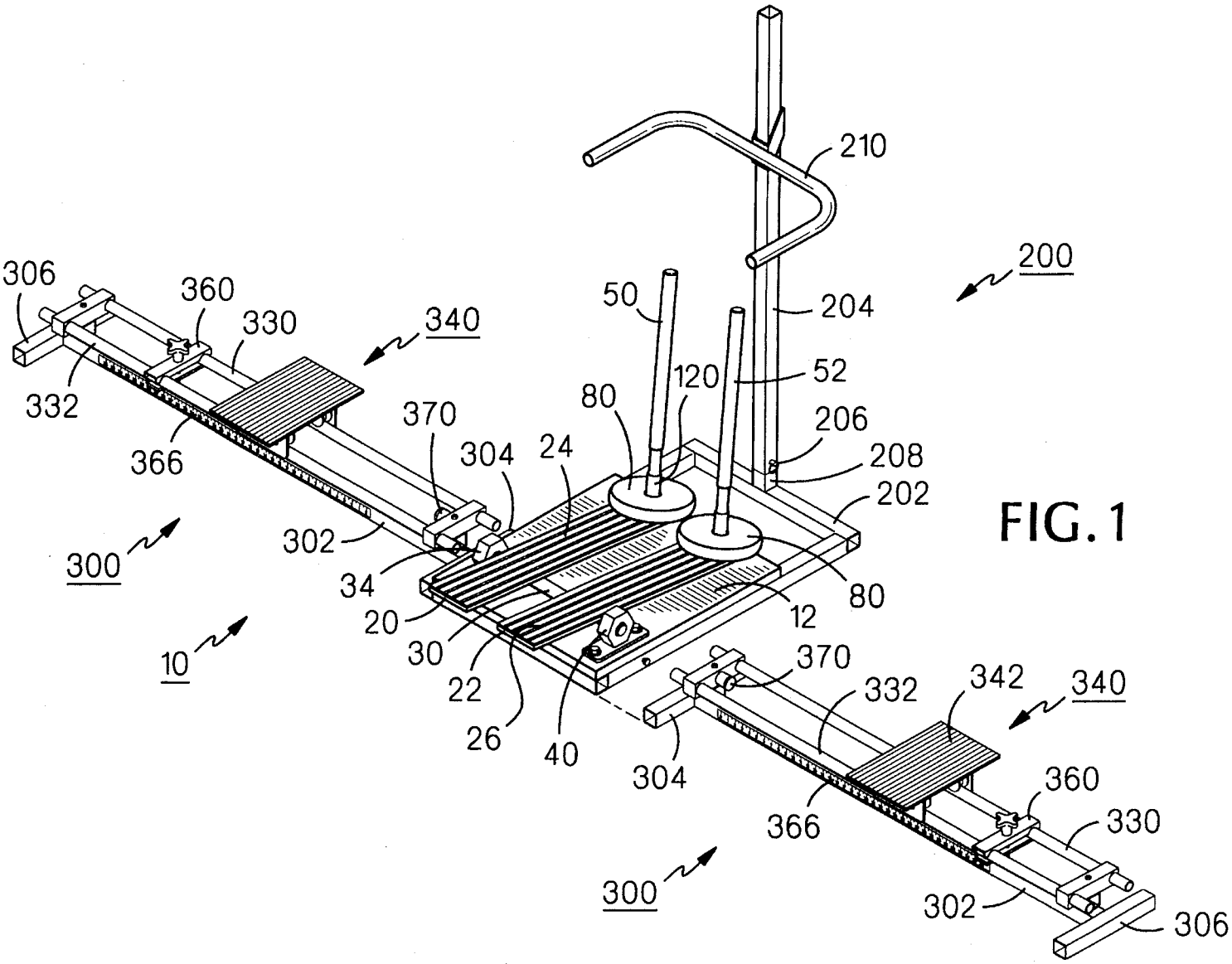
FIG. 1 is is a perspective view of the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Referring to FIG. 1, there is illustrated a combination exercise device according to the present invention, generally indicated by the reference numeral 200. Combination device 200 includes a horizontal, central base frame 202 having a vertical support 204 removably attached thereto by means of a pin 204 extending horizontally through the vertical support near the lower end thereof and through an upstanding stub 208 attached to the frame. A handle bar assembly 210 is adjustably attached to the vertical support.

Mounted on base frame 202 is a lower leg exercise device, according to the above-referenced patent application, and generally indicated by the reference numeral 10. Lower leg device includes a planar base member 12 attached to base frame 202. Base member 12 may be formed from a suitable plastic material, about 18 inches long by about 24 inches wide.

Rotatably mounted on base member 12 are two elongate, steel plates 20 and 22 having, respectively, non-skid rubber layers 24 and 26 adhesively attached to the upper surfaces of the plates. Plates 20 and 22 are fixedly mounted, respectively, on a horizontal shaft 30 journaled in bearing blocks 34 and 40, the bearing blocks being fixedly attached to base member 12. Orthogonally mounted, respectively, on the distal ends of plates 20 and 22 are 1-inch diameter, 16-inches long, aluminum weight posts 50 and 52 for the placement thereon of a number of selected conventional disk-shaped weights, as at 80. The proximal ends of weight posts 50 and 52 are rotatably fixedly attached to horizontal shafts (not shown) which are journaled in a support fitting (not shown) fixedly attached to plates 20 and 22 by means of threaded shafts and nuts (not shown). Cylindrical collars 120 are movable between a first, lowered position in which the collars engage both the lower end of weight posts 50 and 52 and the support fittings, thus locking the weight posts in a position orthogonal to plates 20 and 22, and a second, raised position, permitting the weight posts to be folded down on the plates.

As is more fully described in the above-referenced patent application, a person (not shown) stands on plates 20 and 22, either facing toward or facing away from vertical support 204, and reciprocatingly rotates the plates to exercise, respectively, either the anterior or posterior muscles of the lower legs.

Figure 2:
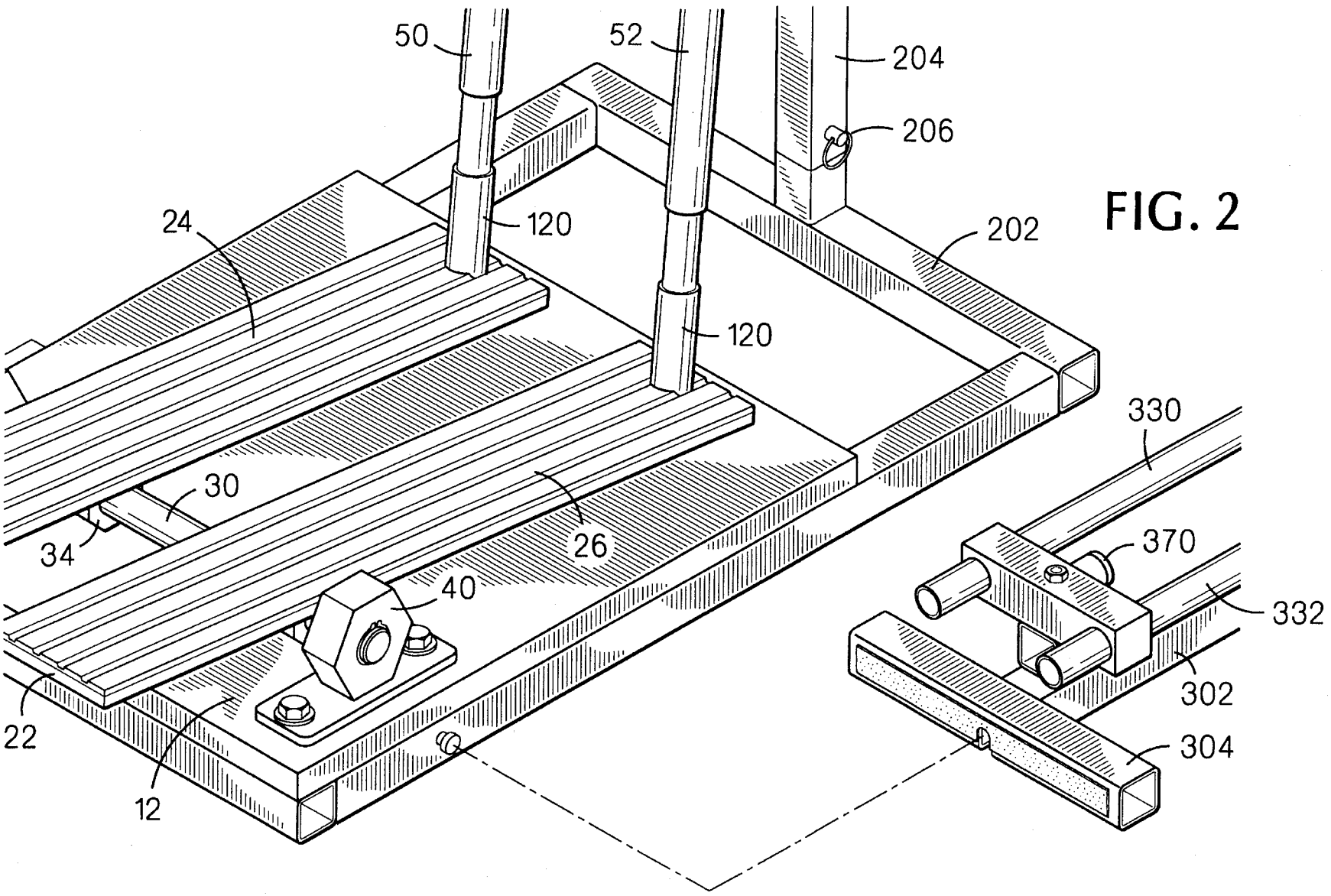
FIG. 2 is a fragmentary, perspective view of the invention showing assembly details thereof.
Figure 3:
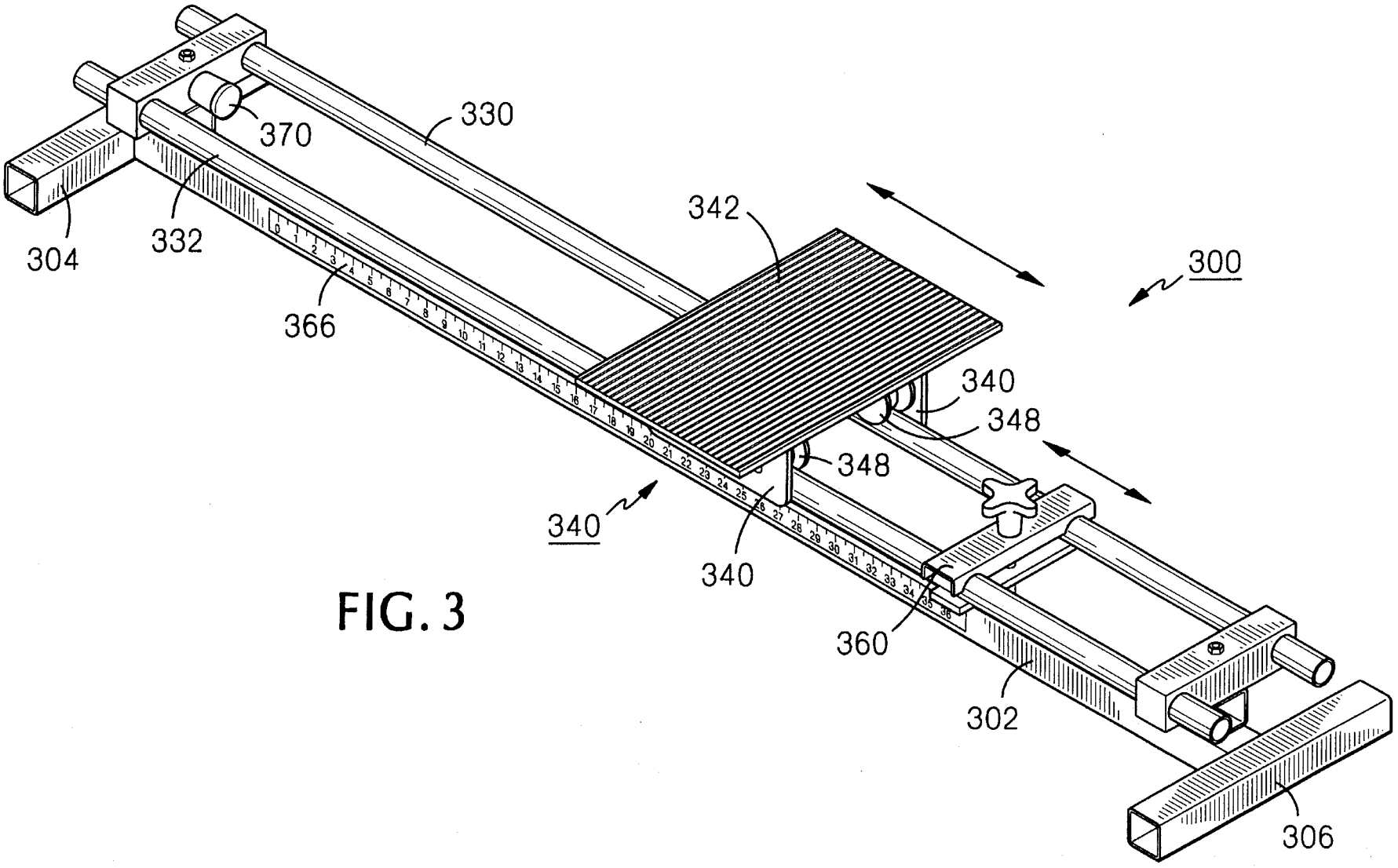
FIG. 3 is a perspective view showing operation of one element of the invention.

A second feature of combination device 200 provides for exercise of inner and outer groups of muscles of the upper legs. Attached to central base frame 202 and extending from either side edge thereof are mirror image track assemblies, generally indicated by the reference numeral 300. With reference also to FIG. 3, each track assembly includes a elongate, horizontal, main frame member 302 having short, horizontal, proximal and distal frame members 304 and 306, respectively, attached to the ends of the main frame member. As is illustrated on FIG. 2, a track assembly 300 is removably secured to central base frame 202 by means of a downwardly facing U-shaped opening defined in the outer vertical wall of proximal frame member 304 engaging a horizontal T-shaped stud attached to a sidewall of the central base frame.

Each track assembly includes two parallel, horizontal, 1-inch diameter, round bars 330 and 332 fixedly mounted on main frame members 302, each pair of bars having mounted thereon, for back and forth movement, a wheeled platform assembly, generally indicated by the reference numeral 340.

Figure 7:
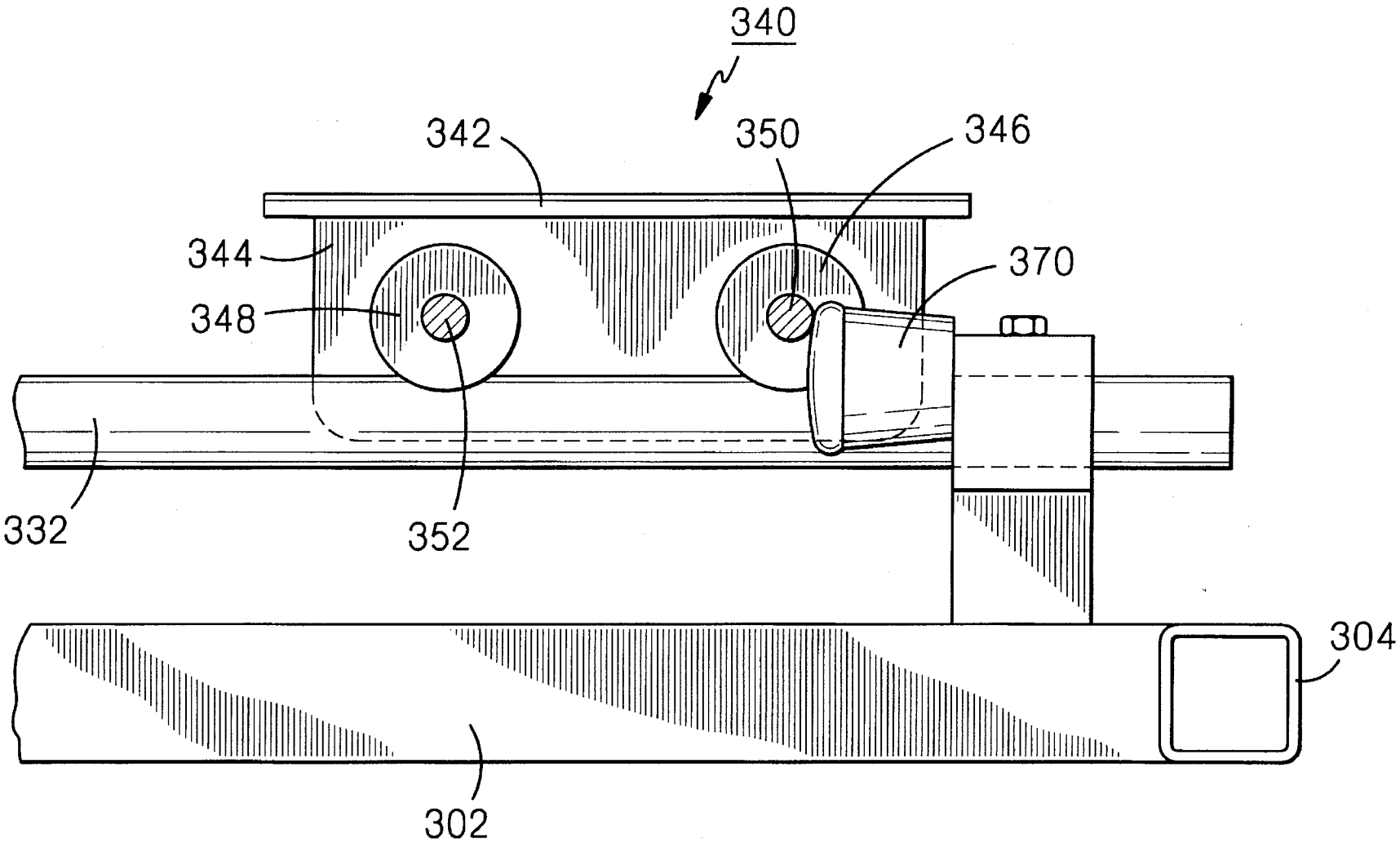
FIG. 7 is a fragmentary, side elevational view, partially in cross-section, of a wheeled platform assembly employed in the invention.

Referring to reference to FIG. 7, each wheeled platform 340 includes an 8-inch by 13-inch upper plate 342 having vertical walls 344 (also FIG. 3), depending from the lower surface of the upper plate, and two pairs of proximal and distal wheels 346 and 348, respectively (also FIG. 3), journaled, respectively, on shafts 350 and 352 extending between vertical walls 344, and rollingly engaging bar pairs 330/332.

In use, a person (not shown) stands with one foot on each wheeled platform 240, grasps handlebar 210 for support and slides the wheeled platforms along bar pairs 330/332 to perform leg splits and exercise the inner and outer sets of thigh muscles. Movement of wheeled platforms 340 toward the distal ends of bar pairs 330/332 is terminated by engagement with adjustable stops 360 (FIG. 3) which are selectively positionable along bar pairs 330/332. Length scales 366 are disposed on surfaces of main frames 302 to permit stops 360 to be evenly spaced from central base frame 202. Movement of wheeled platforms 340 toward central base frame 202 is terminated by the engagement of axles 350 (FIG. 7) with horizontal resilient bumpers 370 fixedly disposed on main frames 302. Handlebar 210 helps the user to pull himself up when drawing wheeled platforms 340 toward central base frame 202 and also helps exercise the arm muscles.

Figure 4:
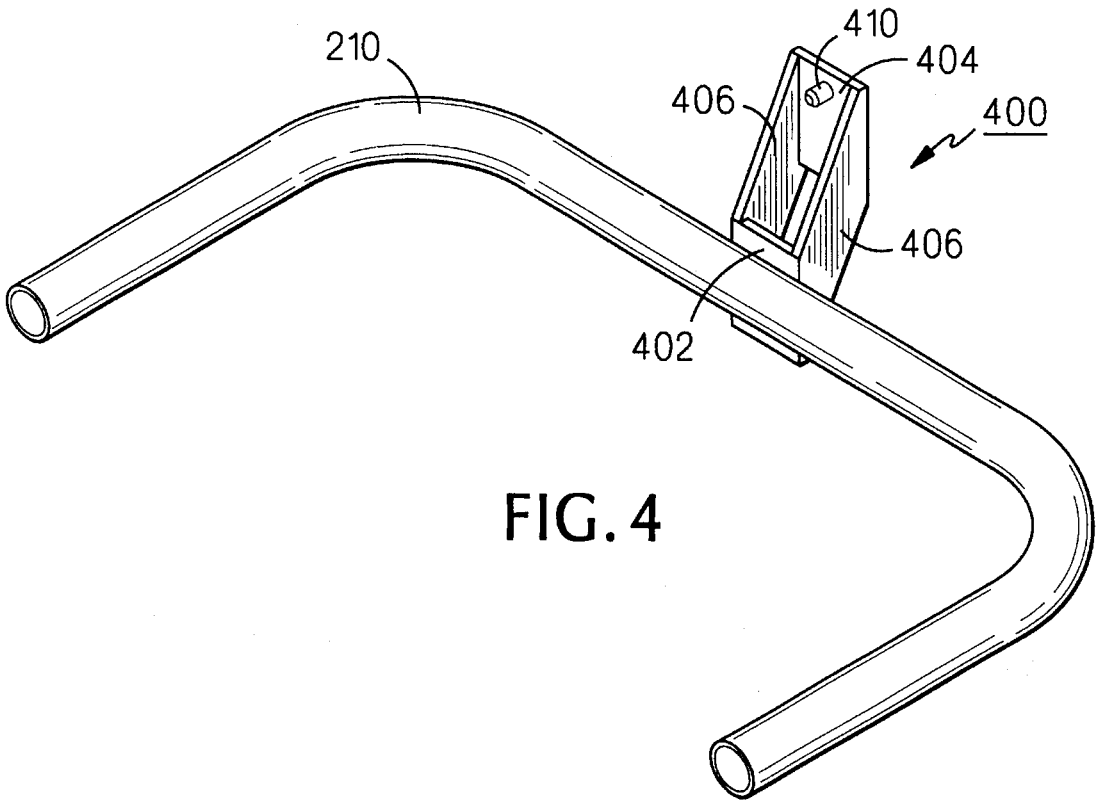
FIG. 4 is a perspective view showing the handlebar support of the invention.
Figure 5:
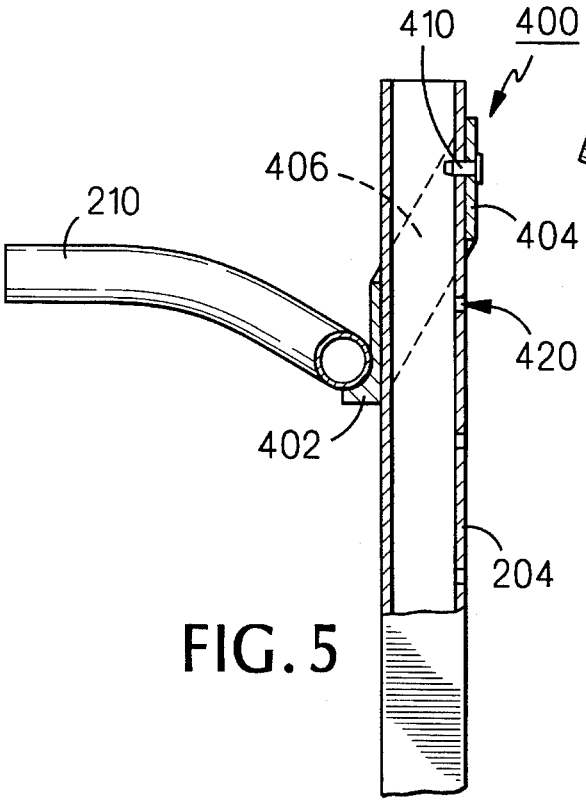
FIGS. 5 and 6 are fragmentary, side elevational views showing the method of adjustment of the handlebar support of FIG. 4.
Figure 6:
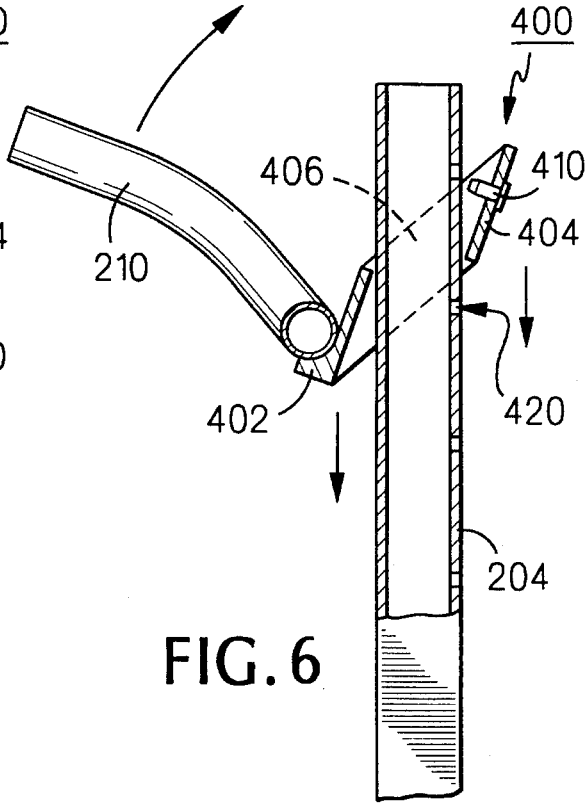

Referring now to FIGS. 4–6, there is illustrated the means by which the vertical height of handlebar 210 on vertical support 204 is adjusted. Handlebar 210 has attached to the medial portion thereof a mounting fixture, generally indicated by the reference numeral 400. Mounting fixture 400 includes a front wall 402 and a rear wall 404 joined by two side walls 406, with the front wall being vertically disposed below the rear wall. A stud 410 attached to rear wall 404 extends horizontally into the volume defined by walls 402, 404, and 406. In position for use (FIG. 5), handlebar 210 is removably attached to vertical support 204 by means of stud 410 being inserted into a selected one of a plurality of holes, as at 420, defined through the rear surface of the vertical support, with front wall 402 engaging the front surface of the vertical support, rear wall 404 engaging the rear surface of the vertical support, and side walls 406 engaging the side surfaces of the vertical support. Thus, handlebar 210 is secured on vertical support 204 against downward, sideways, and/or twisting force.

To adjust the elevation of handlebar 210 on vertical support 204, the handlebar is rotated upwardly toward the vertical support, as is illustrated on FIG. 6, thus releasing stud 410 from a hole 420. Handlebar 210 can now be slid downward, for example, in the direction of the arrow, and repositioned on vertical support 204 by rotating the handlebar in the opposite direction, as stud 410 is inserted into another hole 420.

Combination device 200 is relatively lightweight and can be economically constructed of stock materials using conventional techniques. In the event it is desired to store or transport combination device 200, wheeled platforms 340 are lifted from bar pairs 330/332, track assemblies 300 lifted from engagement with central base frame 202, handlebar 210 lifted from engagement with vertical support 204, the vertical support removed from the base frame, and weight posts 50 and 52 folded down on plates 20 and 22. The whole process is quickly and easily completed. The individual parts can then be stacked for compact storage or transported to a new location for quick and easy reassembly.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A combination leg exercise device, comprising:

(a) a base member;

(b) two, elongate, parallel plates attached to rotating means mounted on said base member; and (c) support means disposed at distal ends of said plates to accommodate thereon selected weights;

such that a person standing on said plates, with a foot disposed over each of said rotating means, moves said weights between a first, lowered position and a second, elevated position by alternatingly flexing and relaxing muscles in the person's lower legs;

said device further comprising:

(d) two track assemblies extending horizontally from said base member; and (e) said track assemblies including thereon two wheeled platforms;

such that a person standing with a foot on each of said platforms, slides said platforms back and forth along said track assemblies by alternatingly flexing and relaxing inner and outer muscles in the person's upper legs.

2. A lower leg exercise device, as defined in claim 1, further comprising: a support attached to said base member for the manual grasping of distal ends of said support by a user of said device.

3. A combination leg exercise device, as defined in claim 2, wherein: said support is selectively vertically adjustable.

4. A combination leg exercise device, as defined in claim 1, wherein: upper surfaces of said wheeled platforms are inclined downwardly toward said base member.

5. A method of exercising leg muscles of a person, comprising:

(a) providing a base member to be placed on a horizontal surface;

(b) providing two, elongate, parallel plates attached to rotating means mounted on said base member;

(c) providing support means disposed at distal ends of said plates to accommodate thereon selected weights;

(d) said person standing on said plates, with a foot over each of said rotating means; and (e) said person moving said weights between a first, lowered position and a second, elevated position by alternatingly flexing and relaxing muscles in said person's lower leg;

said method further comprising:

(f) providing two track assemblies extending horizontally from said base member; and (g) providing two wheeled platforms on said track assemblies;

(h) said person standing with a foot on each of said wheeled platforms; and (i) said person sliding said platforms back and forth along said track assemblies by alternatingly flexing and relaxing inner and outer muscles in the person's upper legs.

6. A method, as defined in claim 5, further comprising: providing a support attached to said base member for the manual grasping of distal ends thereof by said person.

7. A method, as defined in claim 5, further comprising: providing said support selectively vertically adjustable.

8. A method, as defined in claim 5, further comprising: providing upper surfaces of said wheeled platforms inclined downwardly toward said base member.

* * * * *